United States Patent [19]

Kagechika et al.

[11] Patent Number: 4,673,471

[45] Date of Patent: Jun. 16, 1987

[54] METHOD OF ELECTRODEPOSITING A CHROMIUM ALLOY DEPOSIT

[75] Inventors: Hiroshi Kagechika, Yokohama; Akira Tonouchi, Tokyo, both of Japan; Roland Kammel, Berlin, Fed. Rep. of Germany

[73] Assignee: Nippon Kokan Kabushiki Kaisha, Tokyo, Japan

[21] Appl. No.: 925,965

[22] Filed: Nov. 3, 1986

Related U.S. Application Data

[63] Continuation-in-part of Ser. No. 827,472, Feb. 5, 1986, abandoned, which is a continuation of Ser. No. 735,785, May 20, 1985, abandoned.

[30] Foreign Application Priority Data

Aug. 27, 1984 [JP] Japan ..... 59-176759

[51] Int. Cl.[4] ..... C25D 3/56

[52] U.S. Cl. ..... 204/44.5; 204/43.1

[58] Field of Search ..... 204/43.1, 44.5, 123

[56] References Cited

U.S. PATENT DOCUMENTS

| | | | |
|---|---|---|---|
| 2,766,196 | 10/1956 | Yoshida | 204/44.5 |
| 2,822,326 | 2/1958 | Safranek | 204/43.1 |
| 2,927,066 | 3/1960 | Schaer | 204/43.1 |
| 2,990,343 | 6/1961 | Safranek | 204/43.1 |
| 3,111,464 | 11/1963 | Safranek et al. | 204/43.1 |
| 3,954,574 | 5/1976 | Gyllenspetz et al. | 204/43.1 X |
| 4,054,494 | 10/1977 | Gyllenspetz et al. | 204/43.1 X |
| 4,093,521 | 6/1978 | Renton et al. | 204/43.1 |

OTHER PUBLICATIONS

Abner Brenner, "Electrodeposition of Alloys", vol. I and II, pp. 118–119, and 120, (1963).

*Primary Examiner*—G. L. Kaplan

*Attorney, Agent, or Firm*—Moonray Kojima

[57] ABSTRACT

The invention provides a Cr alloy plating bath comprising a sulfate bath consisting essentially of divalent Cr ion and trivalent Cr ion in a total amount of between 1.5 to 2.0 mol/l, cation of one or more than two selected from the group consisting of potassium ion, sodium ion and ammonium ion in a total amount of 1.5 to 2.5 mol/l, and metal ion of one or more than two selected from the group consisting of Fe, Ni and Co, in an amount of less than 0.6 mol/l, wherein the invention provides stable plating, without requiring a separation between electrolytes with a diaphragm, and provides good deposition at high current efficiencies.

3 Claims, 1 Drawing Figure

METHOD OF ELECTRODEPOSITING A CHROMIUM ALLOY DEPOSIT

This application is a continuation-in-part of application Ser. No. 827,472, filed 2-5-86, now abandoned, which in turn was a continuation of application Ser. No. 735,785, filed 5-20-85 now abandoned.

BACKGROUND OF THE INVENTION

1. Field of Invention

This invention relates to an alloy plating bath for providing electroplated deposits of chromium alloy, such as, for example, Cr—Fe, Cr—Fe—Ni, Cr—Ni.

2.Discussion of Prior Art

Many different compositions have been attempted for use in Cr-alloy plating baths, such as, for example, sulfate bath, sulfamic acid bath, chloride bath, chromic acid bath, and fluoborate bath. However, these bath compositions were not practical for industrial use, for a variety of reasons. For example, the chromic acid bath or the fluoborate bath produce deposits of undesirable properties. Also, the solutions of these baths are harmful in handling, and hence, are excluded from practical applications.

Furthermore, the sulfate bath, the sulfamic acid bath and the chloride bath always contain a pH buffer, such as boric acid, a complexing agent, such as citric acid or EDTA, or other organic additives. Thus, although they could produce satisfactory deposits during initial periods of the plating proces, the baths become unstable during electrolysis. In addition, as a substantial problem, uniformity of deposits is deteriorated due to generation of trivalent Fe ion or hexavalent Cr ion, by anodic oxidation. In order to prevent such deterioration a diaphragm is usually provided between the anolyte and the catholyte. However, this is not a practical solution to the problem. For these reasons, it was difficult to use conventional baths for industrial applications.

SUMMARY OF THE INVENTION

Accordingly, an object of the invention is to overcome the aforementioned and other disadvantages and deficiencies of the prior art.

Another object is to provide a Cr-alloy plating bath which has stable plating performance, does not require separation of the electrolyte with a diaphragm, and provides good deposition at high current efficiency.

The aforementioned and other objects are attained by the invention, wherein a sulfate bath contains the necessary elements of divalent Cr ion and trivalent Cr ion in a total amount of 1.5 to 2 mol/l; cation of one or more than two selected from the group consisting of potassium ion, sodium ion and ammonium ion in a total amount of 1.5 to 2.5 mol/l; and metal ion of one or more than two selected from the group consisting of Fe, Ni and Co in an amount of less than 0.6 mol/l.

A feature of the invention is that the Cr ion has extremely high concentration in comparison with the prior art. In the Cr solution of high concentration, trivalent Cr ion and divalent Cr ion are in equilibrium, and divalent Cr ion is assumed to be of higher ratio. In the invention, cathodic current efficiency of Cr is maintained at a high level in the high concentration of Cr ion. When an anode is used without diagphragm in this inventive bath, oxidizing reaction of metal ion may be balanced at a negligible lower level. The phenomenon is also explanable with the divalent Cr ion.

It is also known in the prior art that electrodeposition baths have a lower range concentration of trivalent Cr ions. U.S. Pat. No. 2,990,343, for example, teaches a bath having 20 to 75 grams/liter of trivalent chromium ions and alkali metal salts of 10 to 150 grams/liter. The concentration of chromium ions was found in the prior art to be limited to about 70 grams/liter because salt crystals would precipitate with higher concentrations.

U.S. Pat. No. 2,990,343 is incorporated in this specification by reference for the various conditions and constituents which are usually used in such electrodeposition baths. Where such priorly known salts and constituents are known, only abbreviated reference will be made, with the incorporated reference supplying detailed discussions. Thus, the nature of the aqueous bath, the salts used to obtain the chromium ions, the salts used to obtain the metal ions, the salts used to obtain the alkali ions, and various other conditions, can be found by referring to the referred to U.S. Pat. No. 2,990,343.

The important feature of this invention which is distinguished from the method of U.S. Pat. No. 2,990,343 is the use of high concentration of Cr ions. The lower limit of 1.5 mol/liter is 78.0 grams/liter, in contrast with the highest concentration of the prior art of 75 grams/liter. The higher concentration of Chromium ions in the invention enables the stable plating of chromium without requiring separation of the electrolyte with a diaphragm and provides good deposition with good current efficiency.

Another feature is to maintain high electroconductivity of the bath by containing in high concentration of cation of one or more than two of potassium ion, sodium ion and ammonium ion.

DETAILED DESCRIPTION OF PREFERRED EMBODIMENTS

Figure 1:
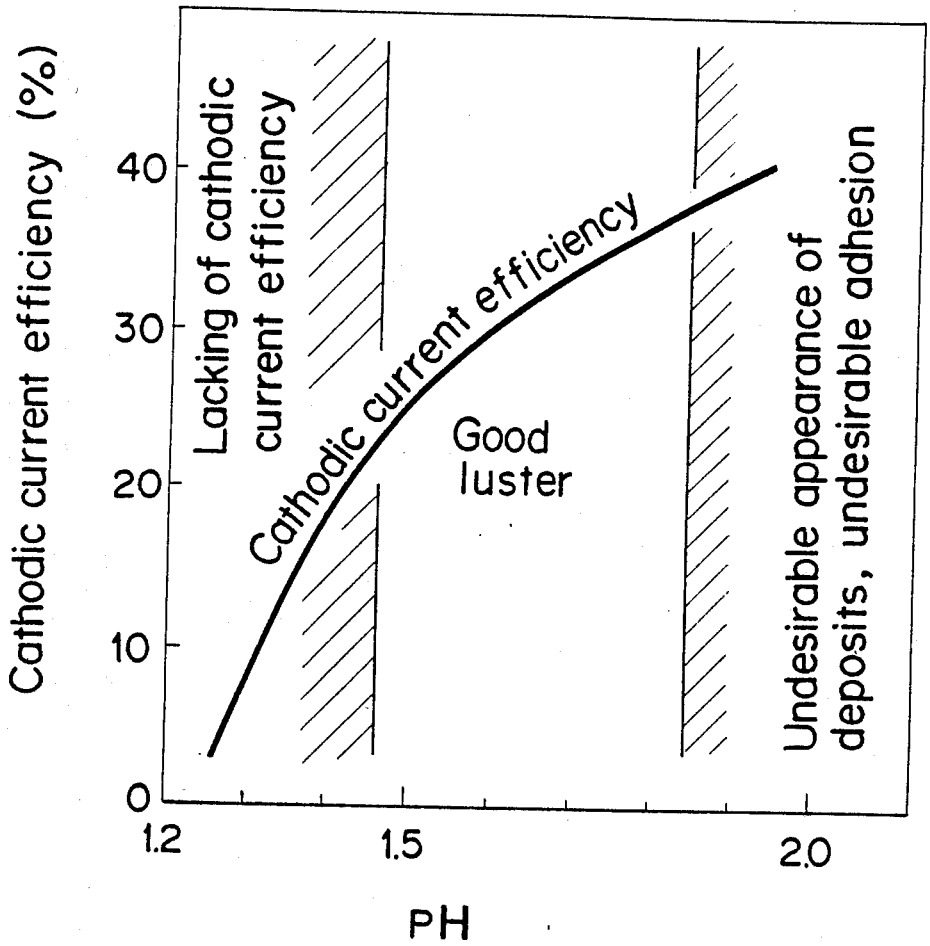
FIG. 1 shows the relationship between pH and cathode current efficiency in a plating bath according to the invention.

The inventive bath is prepared with particular ingredients in amounts wihin certain ranges. If the density of Cr ion, that is, the total amount of divalent Cr ion ($Cr^{2+}$) and trivalent Cr ion ($Cr^{3+}$) were less than 1.5 mol/l, the property of the alloy deposits would be substantially worsened as would be the cathodic current efficiency. If the amount is more than 2 mol/l, its solubility would be worsened. In dependence upon additives of Fe ion or Ni ion, precipitation is caused impreferably. Therefore, divalent Cr ion and trivalent Cr ion must be in an amount of between 1.5 mol/l and 2 mol/l, in total, of 78.0 grams/liter to 104.0 grams/liter.

Potassium ion ($K^+$), sodium ion ($Na^+$) and ammonium ion ($NH_4^+$) are added to maintain high electroconductivity of the bath as discussed above. Increasing the electroconductivity prevents increasing of the temperature on the cathode, so that the property of the deposits (especially uniformity and appearance) is improved. If the total concentration of cation of one or two of the above, is less than 1.5 mol/l, the electroconductivity would be unsatisfactory. However, if the concentration total exceeds 2.5 exceeds 2.5 mol/l, the solubility is worsened. Thus, potassium ion, sodium ion and ammonium ion are added in a range of 1.5 to 2.5 mol/l, in total amount, of one or two thereof. In such cation, potassium ion is most preferable. Potassium ion is advantageous in that covering power is desirous in the potassium containing bath. For providing such effect, it is convenient to use, as a reagent, chrome alum. Fe, Ni and Co are the alloying elements used with Cr, and metal ions of one or two of these are added in an amount of less than 0.6 mol/l per each of these elements in accordance with the desired composition of the deposits. If the amount exceeds 0.6 mol/l, solubility of these elements in the bath is decreased, and is not practical.

With respect to the plating conditions, the optimum range can be selected in accordance with the desired composition of the deposit. The preferred conditions are as follows.

pH The optimum range of pH is between 1.5 to 1.8. Influence by pH is less in the bath of the invention within this range. If the pH were more than 1.8, adhesion of deposits would be deteriorated, and appearance of deposits would be worsened. When the pH becomes low, cathodic current efficiency becomes low. The lower limit of pH at 1.5 provides the necessary cathodic current efficiency.

FIG. 1 shows test results of pH in the bath versus cathodic current efficiency. The plating bath provided alloy deposits of 18% Cr—8%Ni—Fe composition. The bath composition and other conditions were as follows: Bath Composition; Cr, 1.5 mol/l, Ni, 0.4 mol/l, Fe, 0.5 mol/l, and K, 2.0 mol/l. Current Density, 30 A/dm$^2$, Temperature, 50° C.

As seen in FIG. 1, the cathodic current efficiency is lowered when the pH is lowered. It is also seen that a pH of more than 1.5 is required to provide cathodic current efficiency of more than about 20%.

Temperature of Solution. A temperature within the range of from 30° C. to 80° C. is appropriate, with 45° to 55° C., being more preferable. If the temperature is lower than 30° C., the solubility of the ion is not sufficient for deposition.

Current Density. This is determined in relation to the composition of deposits, and is in general suitable from 10 to 20 A/dm$^2$. When alloy deposits of 18%Cr—8%-Ni—Fe composition are desired, the current density in the plating bath, is preferably in the range of 20 to 80 A/dm$^2$. In this range, the current density is practical and appropriate, and furthermore, the variance of the alloy composition is little affected by the current density.

Agitation. To control alloy composition, the flowing condition (agitation conditions) in conventional processes may be used. The inventive bath does not need such specified flowing conditions, however, and such conditions may be used in general. It has been recognized that with increasing flowing rate, the deposits of Cr are reduced, and the relative ratio of Fe and Ni is increased.

The alloy deposits produced from the bath of the composition of the invention are smoothly uniform and lustrous, and have a stainless steel like appearance. Furthermore, the inventive deposits are excellent in adhesion and workability, and are corrosion resistant and wear resistant.

EXAMPLE 1

Rolled Cu sheets (0.8 mm) were subjected to the plating of Cr—Ni—Fe alloy under the condition of Table 1. The compositions of deposits, the cathodic current efficiency, etc, are shown in Table 1, wherein the Cu sheets were pretreated by alkaline cleaning and electrolytic pickling in a 5% sulfuric acid solution.

TABLE 1

| | B | | | | | | | F | | | | | |
|---|---|---|---|---|---|---|---|---|---|---|---|---|---|
| A | Cr | Ni | Fe | K | C | D | E | Cr | Ni | Fe | G | H | I |
| 1 | 1.5 | 0.4 | 0.5 | 2 | 1.6 | 50 | 30 | 21 | 6 | 73 | 6.5 | J | 30 |
| 2 | 1.5 | 0.3 | 0.3 | 2 | 1.6 | 53 | 35 | 20 | 6 | 74 | 6.0 | J | 28 |
| 3 | 1.5 | 0.2 | 0.2 | 2 | 1.6 | 53 | 40 | 35 | 5 | 60 | 5.5 | K | 40 |
| 4 | 1.5 | 0.15 | 0.1 | 2 | 1.7 | 51 | 25 | 20 | 13 | 67 | 3.0 | J | 13 |
| 5 | 2.0 | 0.2 | 0.2 | 2 | 1.5 | 48 | 20 | 21 | 8 | 71 | 5.0 | J | 24 |

Notes:
A = test pieces.
B = Bath compositions (mol/l)
C = pH
D = Temperature (°C.) of solution.
E = Current density (A/dm$^2$)
F = Composition of deposits (wt %)
G = Thickness of deposits (μm)
H = Appearance
I = Cathodic Current Efficiency (%)
J = Lustrous
K = White light Platinum or graphite were used for the anode. In these examples, the amounts of trivalent ion and hexavalent Cr ion in the plating baths were analyzed, and they were found to be balanced as $Fe^{3+} < 1.6$ g/l and $Cr^{6+} < 5$ g/l, notwithstanding the electrolyte, for a long period of time, and did not increase in these values, and undesirable influence of $Fe^{3+}$ and $Cr^{6+}$ to the deposits was not found.

EXAMPLE 2

Rolled Cu sheets (0.8 mm) were subjected to plating of Cr—Fe alloy under conditions set forth in Table 2. The compositions of deposits, cathodic current efficiency, etc, are shown in Table 2. The Cu sheets were pretreated by an alkaline cleaning process and electrolytic pickling in a 5% sulfuric acid solution.

TABLE 2

| | B | | | | | | | F | | | | | |
|---|---|---|---|---|---|---|---|---|---|---|---|---|---|
| A | Cr | Ni | Fe | K | C | D | E | Cr | Ni | Fe | G | H | I |
| 6 | 1.5 | 0 | 0.1 | 1.5 | 1.5-1.7 | 52 | 35 | 56 | 0 | 44 | 4 | J | 32 |
| 7 | 1.5 | 0 | 0.2 | 1.5 | | 51 | 45 | 47 | 0 | 53 | 5 | J | 44 |
| 8 | 2.0 | 0 | 0.2 | 1.5 | | 52 | 35 | 40 | 0 | 60 | 4 | J | 41 |

NOTES: See notes listed under Table 1.

Each sample obtained using the conditions of Table 2, were excellent in luster and adhesion. The composition of the deposits may be changed at deposition by changing the current density, whereby the deposits having Cr of around 40 to 60 wt %, can be obtained with stability.

According to the invention, generation of hexavalent Cr ion and trivalent Fe ion are balanced appropriately, so that desired adhesion and satisfactory appearance may be produced without any separation of the electrolyte with a diaphragm. The plating may be carried out at high efficiencies suitable for industrial applications.

What is claimed is:

1. A method of electrodepositing a chromium alloy plate which comprises electrolyzing an aqueous bath consisting of a chromium salt providing from 1.5 to 2.0 mol/liter of trivalent and divalent ions, alkali salt providing from 1.5 to 2.5 mol/liter of an ion selected from the group consisting of potassium ion, sodium ion and ammonium ion, and a salt of alloying metal providing not less than 0.6 mol/liter of an ion selected from the group consisting of iron, nickel and cobalt; wherein said bath is maintained at a temperature between 30° to 80° C., said bath is maintained at a pH of between 1.5 and 1.8, and said bath is subjected to a current density of between 10 to 80 A/dm$^2$.

2. The methodof claim 1, wherein said metal ion is a combination of iron, nickel and cobalt used together, and said potassium ion is used.

3. The method of claim 1, wherein said metal ion is a combination of iron and cobalt used together, and said potassium ion is used.

* * * * *